US006205592B1

(12) United States Patent
Gouws

(10) Patent No.: US 6,205,592 B1
(45) Date of Patent: Mar. 27, 2001

(54) ITEM OF CLOTHING

(76) Inventor: Petrus Christiaan Gouws, P O Box 40859, Richardsbay 3900 (ZA)

( * ) Notice: Subject to any disclaimer, the term of this patent is extended or adjusted under 35 U.S.C. 154(b) by 0 days.

(21) Appl. No.: 09/251,910

(22) Filed: Feb. 19, 1999

(30) Foreign Application Priority Data

Feb. 20, 1998 (ZA) ..... 98/1436
Sep. 11, 1998 (ZA) ..... 98/8354

(51) Int. Cl.[7] ..... A41D 1/06
(52) U.S. Cl. ..... 2/228; 2/238
(58) Field of Search ..... 2/228, 238, 227

(56) References Cited

U.S. PATENT DOCUMENTS 2,599,769 * 6/1952 MacRae et al. ..... 2/228
3,243,824 * 4/1966 Overholt ..... 2/228
4,223,408 9/1980 Sullivan ..... 2/238
4,310,929 1/1982 Finlay ..... 2/238
4,490,856 * 1/1985 Dost ..... 2/238
4,602,388 7/1986 Underwood et al. ..... 2/238
5,379,462 * 1/1995 Morgan et al. ..... 2/238
5,870,777 * 2/1999 Hans ..... 2/228

FOREIGN PATENT DOCUMENTS 459700 1/1937 (GB) .
WO 96/18315 6/1996 (WO) ..... A41B/1/10

* cited by examiner

*Primary Examiner*—Bibhu Mohanty
(74) *Attorney, Agent, or Firm*—Pillsbury Winthrop LLP

(57) ABSTRACT

The invention relates to running shorts which is made up of a front material panel and a rear material panel stitched together along their side edges. The combined operative top edge of the panels is elasticated whereas the respective bottom edges of the panels are connected at a location between opposite ends of these edges by a string-like element. When wearing the running shorts, only the string-like element will be disposed between the wearer's legs. The running shorts also may have underwear-type briefs secured therein between the front and rear material panels.

9 Claims, 2 Drawing Sheets

ITEM OF CLOTHING

The invention relates particularly to shorts as used for different sports, specifically sports which involve running such as track running, road running, and the like. It is well known that runners that run long distances often suffer from chafing between their legs, chafing generally resulting from their legs rubbing against their shorts. As such, it is an object of this invention to at least alleviate the above problem.

Shorts of the type herein envisaged shall hereinafter be referred to as running shorts, although it must be appreciated that these shorts can be worn for any other sports where chafing could become a problem.

According to the invention there is provided running shorts which comprises a front material panel and a rear material panel, each panel defining an operative top edge, an operative bottom edge and two opposite side edges, the two panels being stitched together along the respective opposite side edges thereof and being connected by a string-like element extending between the operative bottom edges thereof at a location intermediate between the opposite side edges of the panels, the combined operative top edge of the two panels in their stitched together configuration being formed to permit the shorts to be held around the waist of a user.

The material panels particularly are profiled to provide the running shorts with a conventional running shorts-type design.

Furthermore, the string-like element may comprise any one of a conventional-type string element, a lace element, a material strip element, and the like. The location of the string-like element may be such that it separates and defines the spaces within the shorts through which the respective legs of a user must pass when wearing the shorts. As such, in use, the string-like element of the shorts will pass between the legs of the user.

Still further according to the invention, the combined operative top edge of the two material panels may be elasticated or may define a seam which carries either an elastic band or a pull string. Thereby, the operative top edge of the two panels will provide for the running shorts to be held around the waist of a user.

Still further according to the invention, the running shorts may include underwear-type briefs located between the panels, the operative top edge of the briefs being stitched to the panels at a location near the combined operative top edge of the panels.

Generally, the shorts may be formed of any conventional material as is commonly used for shorts for different sports, or a combination of conventional materials, whereas the outward design of the shorts also may be variable.

Further features of the invention are described hereinafter, by way of examples, with reference to the accompanying diagrammatic drawings. In the drawings.

Figure 1:
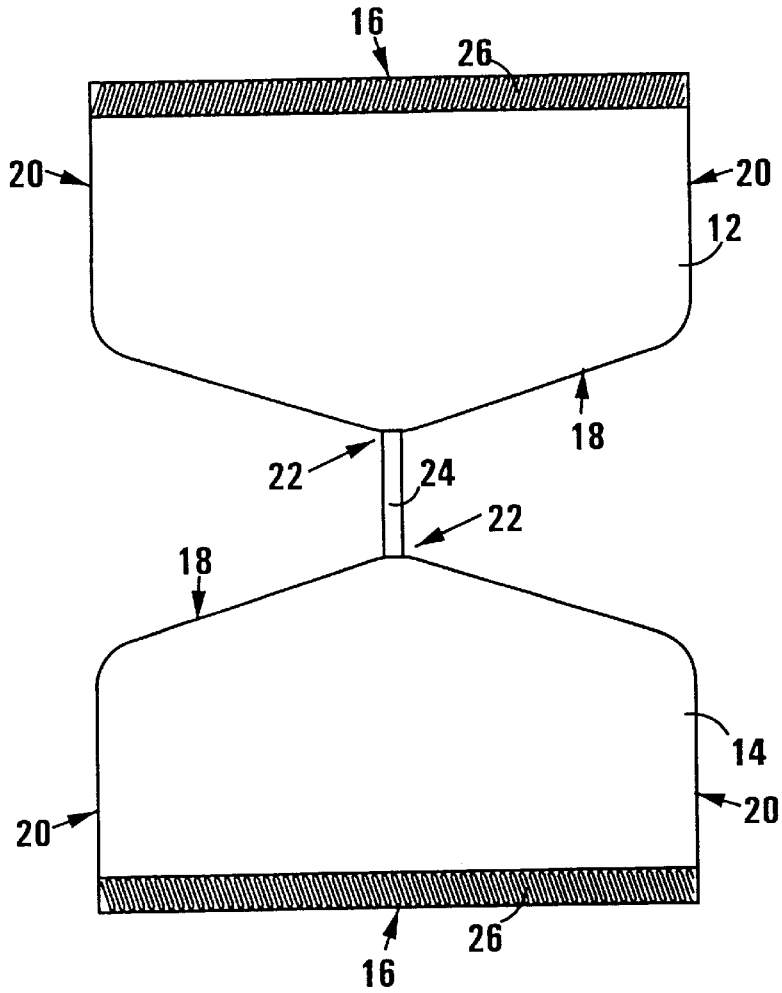
FIG. 1 illustrates the material panel design for running shorts, in accordance with the invention.
Figure 2:
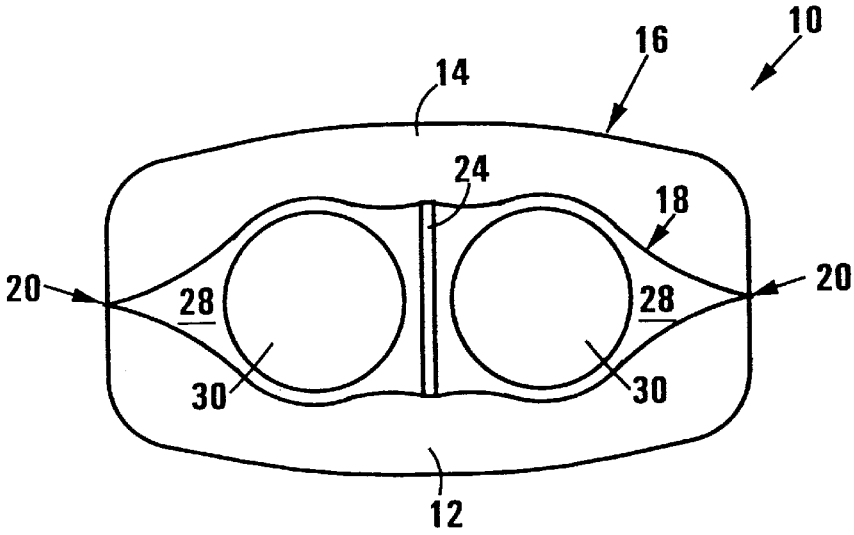
FIG. 2 illustrates in plan view the configuration of a first embodiment running shorts, including the material panels illustrated in FIG. 1.

Referring initially to FIGS. 1 and 2 of the drawings, running shorts, in accordance with the invention, is designated generally by the reference numeral 10. The running shorts 10 comprises a front material panel 12 and a rear material panel 14, each panel defining an operative top edge

16, an operative bottom edge 18 and two opposite side edges 20. As is illustrated clearly in FIG. 1 of the drawings, the operative bottom edges 18 of the panels are profiled, each bottom edge 18 defining an effective apex 22 at a location between the side edges 20 of the panels. The edges 18 are connected with one another by a string element 24 which is secured between the panels in the region where the said apices 22 are defined.

With these bottom edges so connected, the shorts 10 are formed by stitching together the respective opposite side edges 20 of the panels, 12 and 14 respectively, FIG. 2 illustrating the operative configuration of the shorts 10. The operative top edge of the shorts as defined in combination by the edges 16 of the panels, 12 and 14 respectively, is elasticated, either by having an elastic band 26 secured thereto as shown, or by defining a seam within which an elastic band, or the like, is received. This elasticated operative top edge of the shorts 10 clearly provides for holding the shorts around the waist of a user and in this regard it will be understood that a pull string received within a seam also can serve the purpose. The string element 24 may comprise any conventional string section or a stringlike section formed of a material strip, band, or the like. FIG. 2 illustrates the shorts 10 in its operative configuration, the string element 24 in this configuration separating the spaces 28 through which the legs 30 of a wearer will pass when wearing the shorts. When so worn, only the string element 24 will extend between the legs 30 of the wearer and, thereby, the rubbing that conventionally occurs during running, or the like, between a runner's legs and the conventional material segments of his shorts between his legs, is effectively prevented and, thereby, the possibility of chafing is effectively reduced. The shorts 10 is thus expected to provide additional comfort to a runner during running and, particularly, during long distance running by reducing the possibility of chafing occurring between the runner's legs.

Figure 3:
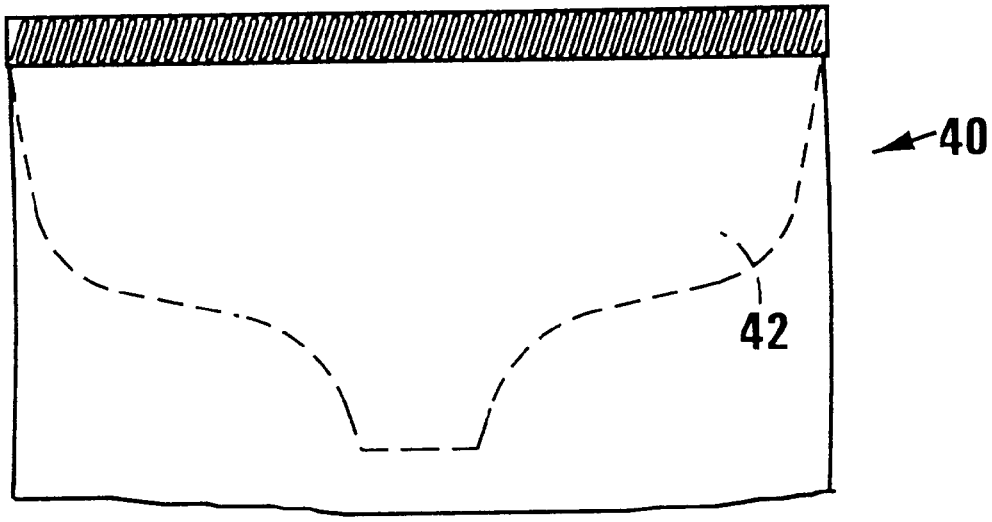
FIG. 3 illustrates in front view the configuration of a second embodiment running shorts, including the material panels illustrated in FIG. 1.

Referring to FIG. 3 of the drawings, a second embodiment running shorts, in accordance with the invention, is designated generally by the reference numeral 40. The running shorts 40 essentially is the equivalent of the running shorts 10, except insofar as the shorts 40 has underwear-type briefs 42 (shown in dotted lines) secured therein, the operative top edge of the briefs being stitched to the panels at a location near the combined operative top edge of the panels as shown. Insofar as the running shorts 40 itself provides for underwear-type briefs, this embodiment running shorts need not be worn together with conventional underwear-type briefs as is required in relation to the running shorts 10 as described above.

The overall design of the running shorts 10, 40 is greatly variable, as well as the material from which the shorts 10, 40 can be formed. The invention extends also to such alternative configuration shorts which still incorporate the features of the shorts as are hereinabove defined and described.

What is claimed is:

1. Running shorts which comprises a one piece front material panel and a one piece rear material panel, each panel defining an operative top edge, an operative bottom edge and two opposite side edges, the two panels being stitched together along the respective opposite side edges thereof and being connected by a string-like element extending between the operative bottom edges thereof at a location intermediate between the opposite side edges of the panels, the combined operative top edge of the two panels in their stitched together configuration being formed to permit the shorts to be held around the waist of a user.

2. Running shorts as claimed in claim 1, in which the material panels are profiled to provide the running shorts with a conventional running shorts-type design.

3. Running shorts as claimed in claim 1, in which the string-like element comprises a string element.

4. Running shorts as claimed in claim 1, in which the location of the string-like element is such that it separates and defines the spaces within the shorts through which the respective legs of a user must pass when wearing the shorts.

5. Running shorts as claimed in claim 1, in which the combined operative top edge of the two panels is elasticated.

6. Running shorts as claimed in claim 1, in which the combined operative top edge of the two panels defines a seam which carries an elastic band.

7. Running shorts as claimed in claim 1, in which the combined operative top edge of the two panels define a seam which carries a pull-string.

8. Running shorts as claimed in claim 1, which includes underwear-type briefs located between the panels, the operative top edge of the briefs being stitched to the panels at a location near the combined operative top edge of the panels.

9. Running shorts as claimed in claim 1, which is formed of a conventional material or a combination of materials as is commonly associated with running shorts.

* * * * *